US006305947B1

(12) United States Patent
Bruce

(10) Patent No.: US 6,305,947 B1
(45) Date of Patent: Oct. 23, 2001

(54) ANGLED COAXIAL CONNECTOR MODULE

(75) Inventor: Burton B. Bruce, New Hartford, CT (US)

(73) Assignee: BERG Technology, Inc., Reno, NV (US)

( * ) Notice: Subject to any disclaimer, the term of this patent is extended or adjusted under 35 U.S.C. 154(b) by 0 days.

(21) Appl. No.: 09/196,926

(22) Filed: Nov. 19, 1998

(51) Int. Cl.[7] ..... H01R 12/00; H01R 9/05
(52) U.S. Cl. ..... 439/63; 439/581
(58) Field of Search ..... 439/63, 581, 79, 439/80, 541.5

(56) References Cited

U.S. PATENT DOCUMENTS

| | | | | |
|---|---|---|---|---|
| 3,201,722 | | 8/1965 | May et al. | 333/84 |
| 4,842,528 | * | 6/1989 | Frantz | 439/80 |
| 5,055,068 | | 10/1991 | Machura et al. | 439/581 |
| 5,088,937 | | 2/1992 | Gabany | 439/581 |
| 5,116,245 | | 5/1992 | Baker | 439/581 |
| 5,161,991 | * | 11/1992 | Bauer | 439/181 |
| 5,169,343 | | 12/1992 | Andrews | 439/608 |
| 5,344,340 | | 9/1994 | Bouleau | 439/581 |
| 5,397,241 | | 3/1995 | Cox et al. | 439/79 |
| 5,516,294 | | 5/1996 | Andrews et al. | 439/63 |
| 5,516,307 | | 5/1996 | Cartesse et al. | 439/581 |
| 5,577,935 | | 11/1996 | Harting et al. | 439/581 |
| 5,641,294 | | 6/1997 | Beard | 439/247 |
| 5,645,454 | | 7/1997 | Kosmala | 439/675 |
| 5,679,006 | | 10/1997 | Madelaine | 439/63 |
| 5,718,606 | | 2/1998 | Rigby et al. | 439/608 |
| 5,842,872 | * | 12/1998 | Hosler, Sr. et al. | 439/63 |
| 5,943,770 | | 8/1999 | Thenaisie et al. | 29/883 |

FOREIGN PATENT DOCUMENTS

| | | |
|---|---|---|
| WO 97/02629 | 1/1997 | (WO) . |
| WO 97/40554 | 10/1997 | (WO) . |

* cited by examiner

*Primary Examiner*—Tulsidas Patel
*Assistant Examiner*—Chandrika Prasad
(74) *Attorney, Agent, or Firm*—Woodcock Washburn Kurtz Mackiewicz & Norris LLP

(57) ABSTRACT

An angled coaxial connector module for being mounted to a circuit board is disclosed. The connector module has a housing with a contact side for mating with a corresponding connector and a connecting side for mounting the connector module to the circuit board. The housing is constructed of an electrically insulating material. At least one electrical contact element extends through the housing between the contact side and the connecting side. The contact element has an electrically conductive inner center contact, an electrically conductive outer shielding tube surrounding the inner center contact at least within the housing, and an insulating member surrounding the inner center contact at least within the housing and electrically isolating the inner center contact and the outer shielding tube. The inner center contact and the outer shielding tube each have a corresponding bent portion within the housing such that the contact side of the housing is at an angle with respect to the connecting side of the housing.

16 Claims, 2 Drawing Sheets

FIG. 1
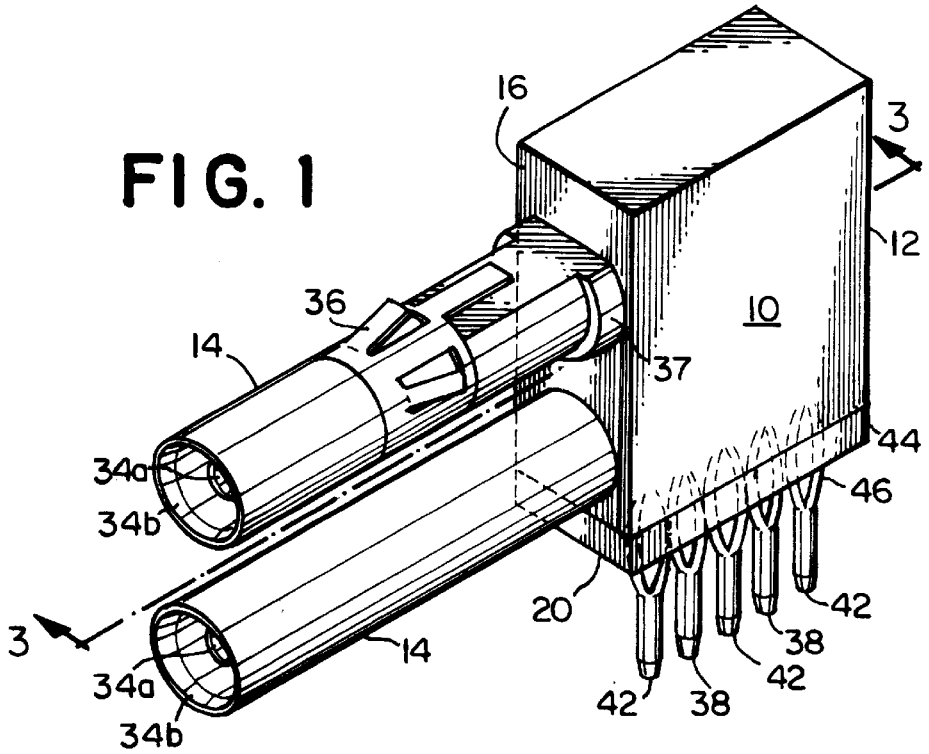
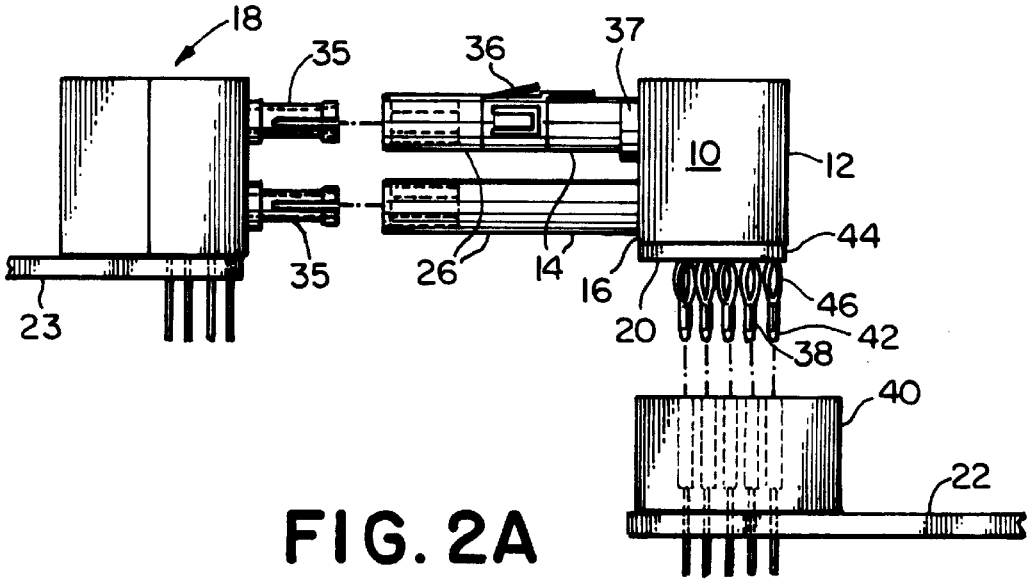
FIG. 2A

ANGLED COAXIAL CONNECTOR MODULE

FIELD OF THE INVENTION

The present invention relates to an angled coaxial connector module for mounting to a circuit board. More particularly, the invention relates to such an angled coaxial connector module which demonstrates relatively high electrical efficiency and which can be manufactured at relatively low cost.

BACKGROUND OF THE INVENTION

Coaxial connector modules are known in the prior art, as shown for example by U.S. Pat. No. 5,169,343. As seen in such patent, coaxial connector modules are employed to electrically connect high frequency signals to a circuit on a circuit board. However, prior art coaxial connector modules includes contact elements with multiple internal connections within a housing. Such internal connections resulted in decreased electrical efficiency, increased parasitic effects, and increased construction costs. These prior devices also included relatively complex housing constructions in order to separately channel multiple high frequency signals and shields, thereby resulting in increased construction and materials costs.

Specifically, in the aforementioned U.S. Pat. No. 5,169,343, within the housing, the center contact of each contact element includes two pieces, each inserted from a respective housing face into a channel, where the two pieces are soldered or welded together inside the housing, and where the channel is then filled with an insulating material. As can be appreciated, such an insertion and assembly process can be cumbersome and prone to error. Moreover, the quality of the joint between the two pieces can be suspect, resulting in electrical inefficiencies that can include unwanted resistive, capacitive, and/or inductive characteristics that might interfere with high frequency signals. As seen in the same patent, the housing includes a block of metal surrounding the insulation and acting as a shield. The use of a block of metal necessarily includes considerable time and expense in milling and drilling to form the required channels therein.

Accordingly, a need still exists for an angled coaxial connector module with contact elements that do not have internal connections that would decrease electrical efficiency. Also, a need exists for such a connector module which is constructed in a cost-effective manner from relatively inexpensive materials such that a relatively high state electrical efficiency is maintained.

SUMMARY OF THE INVENTION

The present invention satisfies the aforementioned needs by providing an angled coaxial connector module for being mounted to a circuit board. The connector module has a housing with a contact side for mating with a corresponding connector and a connecting side for mounting the connector module to the circuit board. The housing is constructed of an electrically insulating material.

At least one electrical contact element extends through the housing between the contact side and the connecting side. The contact element has an electrically conductive inner center contact, an electrically conductive outer shielding tube surrounding the inner center contact at least within the housing, and an insulating member surrounding the inner center contact at least within the housing and electrically isolating the inner center contact and the outer shielding tube. The inner center contact and the outer shielding tube each have a corresponding bent portion within the housing such that the contact side of the housing is at an angle with respect to the connecting side of the housing.

BRIEF DESCRIPTION OF THE DRAWINGS

The foregoing summary, as well as the following detailed description of preferred embodiments of the present invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 1 is a perspective view of an angled coaxial connector module constructed in accordance with a preferred embodiment of the present invention;

FIG. 2A is a side view of the connector module of FIG. 1, and shows such module in relation to a receptacle connected to a circuit board, and also to a mating connector module mated to another circuit board;

DETAILED DESCRIPTION OF PREFERRED EMBODIMENTS

Figure 2B:
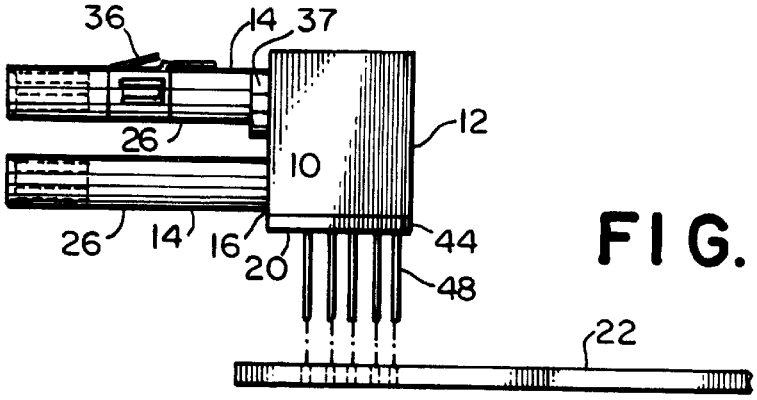
FIG. 2B is a side view of an alternate embodiment of the connector module shown in FIG. 2A.

Certain terminology may be used in the following description for convenience only and is not considered to be limiting. The words 'left', 'right', 'upper', and 'lower' designate directions in the drawings to which reference is made. Similarly, the words 'inwardly' and 'outwardly' are directions toward and away from, respectively, the geometric center of the referenced object. The terminology includes the words above specifically mentioned, derivatives thereof, and words of similar import.

Referring to the drawings in detail wherein like numerals are used to indicate like elements throughout, there is shown in FIG. 1 an angled coaxial connector module 10 in accordance with a preferred embodiment of the present invention. As seen in FIG. 1, the connector module has a housing 12 and at least one electrical contact element 14 (two are shown). The housing 12 has a contact side 16 for mating connector module 10 with a corresponding connector 18 and a connecting side 20 for mounting connector module 10 to a printed circuit board 22 (shown in FIGS. 2A and 2B). Preferably, the housing 12 is constructed of an electrically insulating material such as a plastic or elastomeric material. It is noted that other electrical insulating materials may be employed without departing from the spirit and scope of the present invention.

As seen in the drawings, the connector module 10 has two electrical contact elements 14. It is noted that any other number of electrical contact elements 14 may be employed in the connector module 10 without departing from the spirit and scope of the present invention. Of course, physical constraints incumbent in the dimensions of any given housing 12 and contact element 14 will as a practical matter limit the number of such contact elements 14 that will fit into such housing 12. Preferably, if the connector module 10 has a plurality of electrical contact elements 14, such elements 14 are arranged in rows and columns on the contact side 18 of the housing. For example, and as particularly seen in FIG. 1, the connector module 10 shown has a pair of electrical contact elements 14 arranged in one column and two rows. However, most any arrangement of contact elements 14 may be employed without departing from the spirit and scope of the present invention. For example, the contact elements 14 may be arranged in staggered rows.

Figure 3A:
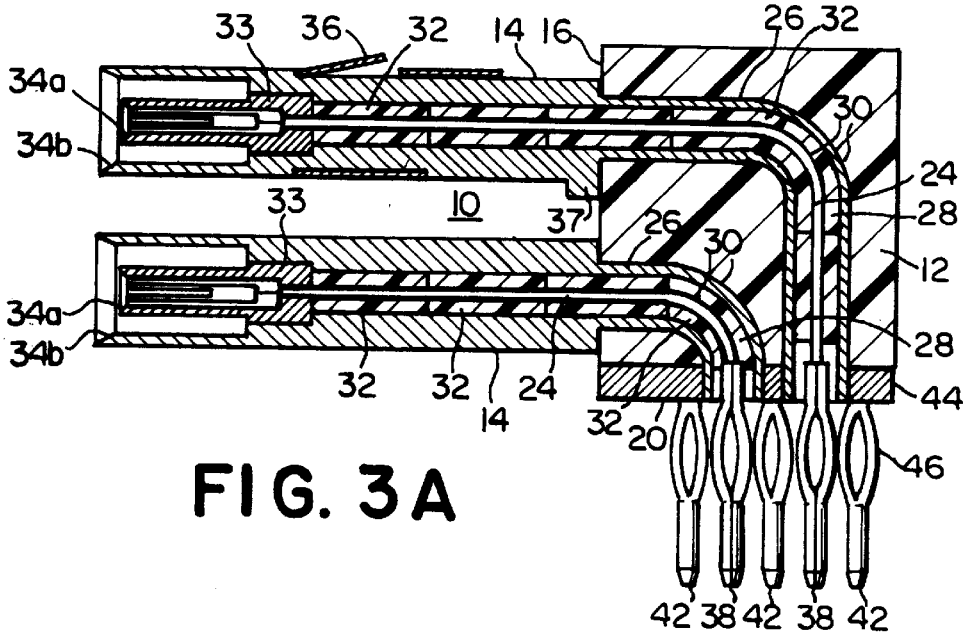
FIG. 3A and 3B are, respectively, cross-sectional views of the connector modules shown in FIGS. 2A and 2B, taken along the line 3—3 of FIG. 1.
Figure 3B:
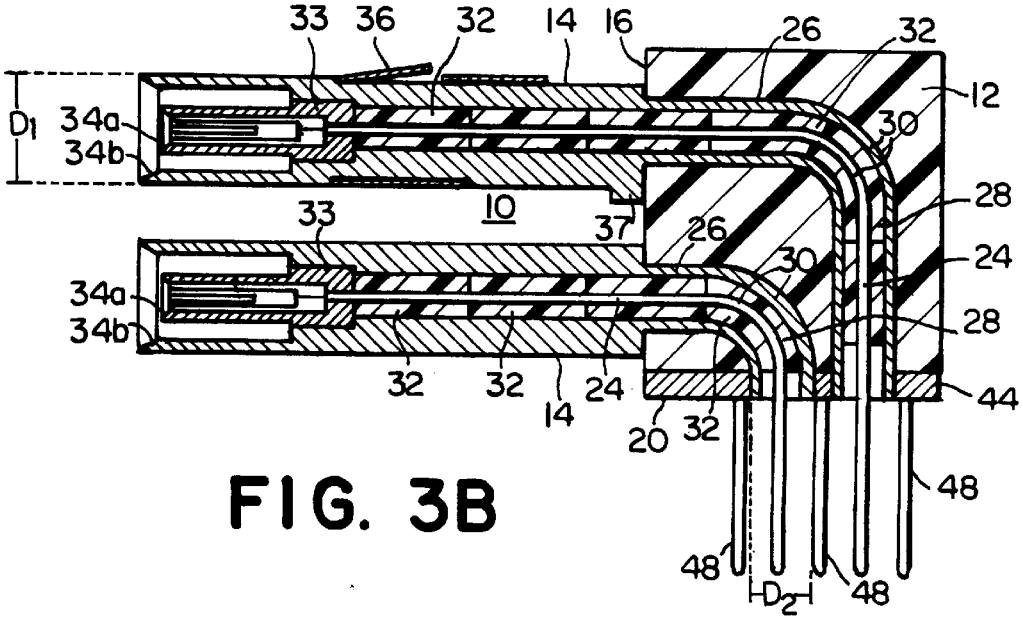

Referring now to FIGS. 3A and 3B, each contact element 14 is shown to extend through the housing 12 between the contact side 16 and the connecting side 20. Preferably, and as shown, the contact elements 14 extend through the housing 12 to the connecting side 20 while maintaining the aforementioned row and column arrangement, although other internal arrangements may be employed without departing from the spirit and scope of the present invention. Each contact element 14 has an electrically conductive inner center contact 24 and an electrically conductive outer shielding tube 26 surrounding the inner center contact 24 at least within the housing 12. Preferably, each of the inner center contact 24 and the outer shielding tube 26 is formed as a substantially unitary body (i.e., as one piece). For example, each element 24, 26 may be molded, or may be appropriately rolled from a sheet of material. As was noted above, by avoiding multiple interconnected pieces, resulting electrical inefficiencies are avoided. Such electrical inefficiencies include unwanted resistive, capacitive, and/or inductive characteristics that might interfere with high frequency signals. Preferably, each of the inner center contact 24 and the outer shielding tube 26 is constructed of trial or another similar electrically conductive material. However, other electrically conductive materials may be employed without departing from the spirit and scope of the present invention.

Preferably, each contact element 14 also includes an insulating member 28 that surrounds the inner center contact 24 at least within the housing 12 and that electrically isolates the inner center contact 24 and the outer shielding tube 26. Preferably, the insulating member 28 is constructed of PTFE (i.e., TEFLON) or another similar plastic or clastomeric material, although other insulating materials may be employed in connection with the insulating member 28 without departing from the spirit and scope of the present invention.

As best shown in FIGS. 3A and 3B, to allow the contact side 16 of the housing 12 to be at an angle with respect to the connecting side 18 thereof, while at the same time avoiding constructing each of the inner center contact 24 and the outer shielding tube 26 of multiple parts, it is preferable that each of the inner center contact 24 and the outer shielding tube 26 have corresponding bent portions 30 within the housing 12. Preferably, and as shown, the contact side 16 of the housing 14 is at a substantially right angle with respect to the connecting side 20 of the housing side 14. Accordingly, and as seen in FIGS. 2A and 2B, the right angle connector module 10 may be mounted on the circuit board 22 and coupled with the corresponding right angle connector 18, with the net result being that the circuit board 22 and circuit board 23 occupy substantially parallel planes. However, it may be desirable that the circuit boards 22 and 23 not occupy parallel planes. More generally, the contact side 16 of the housing 14 may be at practically any angle with respect to the connecting side 20 of the housing side 14 without departing from the spirit and scope of the present invention.

Preferably, each contact element 14 is constructed to be a substantially linear (i.e., straight), then is bent in an appropriate area by an appropriate mechanical device or assembly, and then is incorporated within or molded within the connector module 10. Such appropriate bending device or assembly is known, and therefore need not be further described here.

Preferably, and as seen in FIGS. 3A and 3B, the insulating member 28 comprises a series of discrete insulating beads 32, at least within the housing 12, where each bead 32 is relatively flexible. As shown, the beads 32 are necessarily positioned within the outer shielding tube 26 and surrounding the inner center contact 24. Preferably, each bead has a relatively short axial length as compared with the length of the contact element 14. Each insulating bead 32 is appropriately positioned adjacent neighboring insulating beads 32 such that electrical isolation between the inner center contact 24 and the outer shielding tube 26 is maintained, even at the bent portions 30. Importantly, the flexibility of the insulating beads 32, especially in the vicinity of the bent portion 30, should prevent bead disintegration that could potentially occur as a result of bending the electrical contact element 14 including the beads 32.

As best seen in FIGS. 3A and 3B, each contact element 14, including the inner center contact 24, the insulating member 28, and the outer shielding tube 26, preferably extends outside the housing 12 from the contact side 16 a predetermined distance which is appropriate for interconnection to the corresponding connector 18 (as seen FIG. 2A). As seen, at the extension from the contact side 16, each inner center contact 24 terminates in a female member 34*a* surrounded by an insulating collar 33, and each outer shielding tube 26 terminates at a female member 34*b* coaxial with and exterior to the female member 34*a* and the collar 33. Accordingly, a corresponding male-male termination 35 on the corresponding connector 18 (FIG. 2A) can be received by each electrical contact element 14 of the connector module 10. However, each electrical contact element 14 may terminate at the extension from the contact side 16 in any appropriate manner without departing from the spirit and scope of the present invention.

Owing to the dimensions of each termination 35 on the corresponding connector 18, it may be necessary that the outer shielding tube 26 of each contact element 14 have a relatively large first cross-sectional diameter D1 at the extension from the contact side 16 outside the housing 12, as illustrated in FIGS. 3B. However, such relatively large diameter D1 may not be necessary and may in fact be too large inside the housing 12. In such case, it is preferable that the outer shielding tube 26 have a relatively small second cross-sectional diameter D2 inside the housing 12, as also illustrated in FIG. 3B. The relative diameters D1, D2 of the outer shielding tube 26 both inside and outside the housing 12, can and will vary.

If desired, the connector module 10 may also include a retention clip 36 to retain the connector module 10 in a coupled relationship with the corresponding connector 18 (FIG. 2A). Preferably, and as best seen in FIG. 1, the retention clip 36 is positioned or formed on the outer shielding tube 26 of one of the contact elements 14 outside the housing 12. Retention clip 36 includes a springed tab or the like that securely retainingly engages a receiving recess (not shown) in the corresponding connector 18 to lock the connector module 10 in a mated position therewith.

Preferably, the corresponding connector 18 includes a shroud extending out from the main body thereof (not shown) to form a cavity within which the terminations 35 reside. The previously mentioned receiving recess is formed in such shroud. The shroud may also have various other slots, apertures, etc. (not shown) for receiving corresponding projections, keys, etc. associated with the connector module 10. One such key 37 can be seen in the drawings as a shaped radial extension on one of the outer shielding tubes 26 adjacent the contact side 16 of the housing 12. As should be understood, then, the connector module 10 and the corresponding connector 18 would form a matched set based on such projections, keys, apertures, slots, etc.

Referring to FIGS. 3A and 3B now, the housing 12 is preferably formed by pre-positioning each contact element 14 and then molding the housing material (e.g., plastic) over the pre-positioned elements to form a plastic over-molded housing 12. The plastic over-molded housing 12 provides structural support to the contact elements 14. Methods for performing plastic over-molding are known and therefore need not be further described here. Preferably, the molded plastic that forms the housing 12 has an appropriate dielectric constant such that stray capacitive coupling between each of the contact elements 14 is minimized, thereby minimizing cross-talk between the contact elements 14.

Referring specifically to FIG. 3A, it is seen that in the preferred embodiment of the present invention, a first releasable insertion pin 38 is electrically coupled to the inner center contact 24 of each contact element 14 at the connecting side 20 of the housing 12. As seen, the first pin 38 preferably extends coaxially from the inner center contact 24 outside the housing 12 a predetermined distance. Such first pin 38 can either be releasably coupled to a complimentary pin-receiving receptacle block or pin receiver 40 (shown in FIG. 2A) or inserted into pre-formed bores in a circuit board. Preferably, and as should be understood, the pin receiver 40 is securely mounted to the circuit board 22. Thus, the connector module 10 and each inner center contact 24 thereof can be releasably electrically and mechanically coupled to the circuit board 22 by way of each first pin 38.

Like each inner center contact 24, each outer shielding tube 26 should also be releasably electrically coupled to circuit board 22. It is preferable that at least one second insertion pin 42 be electrically coupled to the outer shielding tube 26 of each contact element 14 at the connecting side 20 of the housing 12. As with each first pin 38, each second pin 42 also extends from the housing 12 a predetermined distance such that each second pin 42 can be releasably coupled to either pin receiver 40 or inserted into bores formed in a circuit board.

The connector module 10 has a shield plate 44 positioned on the connecting side 20 of the housing 12. Preferably, shield plate 44 is mechanically coupled to the housing 12 during the aforementioned plastic over-molding of the housing 12. As best seen in FIGS. 3A and 3B, the shield plate 44 abuts and is electrically coupled to the outer shielding tube 26 of each contact element 14. Thus, the outer shielding tube 26 of each contact element 14 is electrically coupled to one another by way of the shield plate 44. Preferably, the shield plate includes apertures through which each first pin 38 may be inserted and coupled to a respective inner center contact 24. The shielding plate 44 should not violate the electrical isolation of each inner center contact 24 and any outer shielding tube 26.

With the shield plate 44, it is preferable that each second pin 42 be electrically coupled to the shield plate 44. Since the outer shielding tubes 26 are electrically coupled to one another by way of the shield plate 44, the number of second pins 42 need not necessarily correspond to the number of contact elements 14. Instead, and as is shown in FIGS. 1, 2A, and 3A the number of second pins 42 may differ. The exact number of second pins 42 employed will vary based upon many considerations, all without departing from the spirit and scope of the present invention.

As shown in FIG. 3A, each first pin 38 is a separate element from its corresponding inner center contact 24, and is therefore mechanically coupled thereto. Likewise, each second pin 42 is a separate element from the shield plate 44, and is therefore mechanically coupled thereto by any suitable means. Preferably, the mechanical coupling is achieved by micro-butt-welding such that unwanted resistance, capacitance, inductance, and other electrical characteristics are avoided or at least minimized. Each first pin 38 and its corresponding inner center contact 24 may be formed as a substantially unitary body, and second pins 42 and shield plate 44 may likewise be formed as a substantially unitary body, without departing from the spirit and scope of the present invention. As shown, each of the first and second insertion pins 38, 42 includes an expanded mid-portion 46 in order to maintain a tight interference fit when the pin is inserted in either receiver 40 or bores in a circuit board. However, the particular design and construction of the first and second insertion pins 38, 42 may differ without departing from the spirit and scope of the present invention.

Referring now FIG. 3B, it is seen that in an alternate embodiment of the present invention, the first pins 38, have been replaced by extending the inner center contact 24 of each contact element 14 extends outside the housing 12 from the connecting side 20 a predetermined distance. The connector module 10 is secured directly to the circuit board 22 by the extension of each inner center contact 24 by any appropriate means such as soldering. Preferably, and as also seen FIG. 3B, pins 48 are electrically coupled to the shield plate 44 and extend in substantially the same direction and distance as the extensions of the inner center contacts 24 from the housing 12. Pins 48 can also be employed to secure the connector module 10 directly to circuit board 22. Preferably, the pins 48 are micro-butt-welded to the shield plate 44. Pins 48 and the shield plate 44 may also be formed as a substantially unitary body, without departing from the spirit and scope of the present invention.

In the foregoing description, it can be seen that the present invention comprises a new and useful angled coaxial connector module. The contact elements of the connector module do not have internal connections that would decrease electrical efficiency. Also, the connector module may be constructed in a cost-effective manner from relatively inexpensive materials such that a relatively high state electrical efficiency is maintained. Changes could be made to the embodiments described above without departing from the broad inventive concepts thereof. It is understood, therefore, that this invention is not limited to the particular embodiments disclosed, but it is intended to cover modifications within the spirit and scope of the present invention as defined by the appended claims.

What is claimed is:

1. An angled coaxial connector module for mounting to a circuit board, the connector module comprising:

a housing having a contact side for mating with a corresponding connector and a connecting side for mounting the connector module to the circuit board, the housing being constructed of an electrically insulating material; and at least one electrical contact element extending through the housing between the contact side and the connecting side, the contact element having an electrically conductive inner center contact, an electrically conductive outer shielding tube surrounding the inner center contact at least within the housing, and an insulating member surrounding the inner center contact at least within the housing and electrically isolating the inner center contact and the outer shielding tube, the inner center contact and the outer shielding tube each having a corresponding bent portion within the housing such that the contact side of the housing is at an angle with respect to the connecting side of the housing.

2. The connector module of claim 1 wherein the insulating member comprises a series of insulating beads.

3. The connector module of claim 1 comprising a plurality of electrical contact elements arranged in rows and columns in the housing.

4. The connector module of claim 1 wherein the inner center contact is formed as a substantially unitary body.

5. The connector module of claim 1 wherein the outer shielding tube is formed as a substantially unitary body.

6. The connector module of claim 1 wherein the contact element extends outside the housing from the contact side a predetermined distance.

7. The connector module of claim 6 wherein the outer shielding tube of the contact element has a first, larger cross-sectional diameter outside the housing and a second, smaller cross-sectional diameter inside the housing.

8. The connector module of claim 6 further comprising a retention clip on the outer shielding tube of the contact element outside the housing.

9. The connector module of claim 1 wherein the housing is a plastic overmolded housing.

10. The connector module of claim 1 wherein the inner center contact of the contact element extends outside the housing from the connecting side a predetermined distance.

11. The connector module of claim 1 further comprising a first insertion pin electrically coupled to the inner center contact of the contact element at the connecting side of the housing, the first insertion pin extending coaxially from the inner center contact outside the housing a predetermined distance for being coupled to a complementary pin receiver associated with the circuit board.

12. The connector module of claim 11 further comprising a second insertion pin electrically coupled to the outer shielding tube of the contact element at the connecting side of the housing, the second insertion pin extending outside the housing a predetermined distance for being coupled to a complementary pin receiver associated with the circuit board.

13. The connector module of claim 12 further comprising a shield plate at the connecting side of the housing, the shield plate being electrically coupled to the outer shielding tube of the contact element at the connecting side of the housing, the second insertion pin being electrically coupled to the shield plate at the connecting side of the housing.

14. The connector module of claim 11 wherein the first insertion pin and the inner center contact are formed as a substantially unitary body.

15. The connector module of claim 11 wherein the first insertion pin is mechanically coupled to the inner center contact at the connecting side of the housing.

16. The connector module of claim 11 wherein the contact side of the housing is at a substantially right angle with respect to the connecting side of the housing.

* * * * *